United States Patent [19]

Millner et al.

[11] Patent Number: 4,567,793

[45] Date of Patent: Feb. 4, 1986

[54] METHOD FOR MAKING A NIB FOR A DRAWING DIE

[75] Inventors: William O. Millner, Huntington; Gregory A. Hogge, Fort Wayne, both of Ind.

[73] Assignee: Fort Wayne Wire Die, Inc., Fort Wayne, Ind.

[21] Appl. No.: 524,790

[22] Filed: Aug. 19, 1983

[51] Int. Cl.[4] ..... B21K 5/20; B21C 3/18

[52] U.S. Cl. ..... 76/107 A; 72/467

[58] Field of Search ..... 72/467, 274; 76/107 A, 76/107 R; 29/402.19

[56] References Cited

U.S. PATENT DOCUMENTS

| | | | |
|---|---|---|---|
| 2,146,788 | 2/1939 | Blount | 72/274 |
| 3,740,990 | 6/1973 | Prajsnar et al. | 72/467 |
| 4,129,052 | 12/1978 | Bieberich | 72/467 |
| 4,144,739 | 3/1979 | Corbin | 72/467 |
| 4,241,625 | 12/1980 | Corbin et al. | 72/467 |
| 4,365,502 | 12/1982 | Carson | 72/467 |

FOREIGN PATENT DOCUMENTS

| | | | |
|---|---|---|---|
| 891236 | 9/1953 | Fed. Rep. of Germany | 72/467 |
| 56011 | 3/1944 | Netherlands | 72/467 |
| 604603 | 4/1978 | U.S.S.R. | 72/274 |
| 768519 | 10/1980 | U.S.S.R. | 72/467 |

OTHER PUBLICATIONS

Syndie Technical Data Sheet, 30. 4. 83, Determination of Maximum Soft Wire Size (MM.).

American Standards Association, Jun. 9, 1964, American Standard Specifications for Carbide Nibs and Dies for Drawing Round Wire and Bars, pp. 5–13.

Wire World International, vol. 14, Sep./Oct. 1972, Wolfgang Teller, The Use and Maintenance of Drawing Tools (II.).

The Carbide and Tool Journal, Kenneth E. Glen, Die Design and Automatic Finishing Increase Die Life, Nov.-Dec., 1981, pp. 4–7.

The Importance of Die Profile in Wire Drawing, P. R. Lancaster, University of Bradford, England, May 1975.

*Primary Examiner*—Daniel C. Crane

*Attorney, Agent, or Firm*—Albert L. Jeffers; Stephen T. Belsheim

[57] ABSTRACT

A nib for a drawing die, and a method of its manufacture, is provided wherein subsequent nibs recut from the original nib are geometrically similar to the original nib, thereby minimizing the increase in the lengths of the reduction cavity and bearing cavity.

8 Claims, 4 Drawing Figures

METHOD FOR MAKING A NIB FOR A DRAWING DIE

BACKGROUND OF THE INVENTION

1. Field of the Invention

This invention pertains to a drawing die, and more particularly to a nib for a drawing die and method wherein subsequent nibs recut from the original nib maintain geometric similarity.

2. Description of the Prior Art

Typically, a drawing die comprises a casing and a nib secured in the casing, and the incoming material to be drawn is drawn through and reduced in transverse dimension by the nib. The nib is generally made of a hard substance, such as carbide, natural diamond, manufactured diamond and the like. The nib has several cavities through which the incoming material is passed to be drawn. Those cavities are in sequence the entrance cavity, reduction cavity, bearing cavity, and exit cavity. The entrance angle of the entrance cavity is greater than the reduction angle of the reduction cavity, and the drawing of the incoming material is performed in the reduction cavity. The bearing cavity is generally of cylindrical shape, and the exit cavity angles outwardly from the bottom of the bearing cavity.

In the drawing process, the size of the nib, i.e., the size of the cavities, is determined by the size of the incoming material to be drawn so that the impact plane generally lies transversely approximately midway in the reduction cavity. Typically, it is desirable that the material is drawn through about 50% to 60% of the reduction cavity. The bearing cavity size determines the ultimate transverse dimension of the drawn product.

After prolonged use, the reduction cavity and bearing cavity tend to wear and become unusable in producing a satisfactory drawn product. The worn nib is then recut to a larger size for use with larger incoming material to be drawn. It is with the recut nib that problems arise in the prior art. For example, most nibs have an entrance cavity with a curved sloping surface that tapers inwardly and downwardly to the reduction cavity. Upon being recut, the length of the reduction cavity is increased, thereby decreasing the length of the entrance cavity. This reduction of the length of the entrance cavity presents the undesirable condition of effectively lowering the position of the impact plane in the reduction cavity to a point where only about 30% of the reduction cavity is used for drawing the material.

Another problem is that upon being recut, a sharp edge is formed at the transition of the entrance cavity and reduction cavity which, if not refinished, blended, or polished, can scratch or mar the surface of the incoming material to be drawn, and consequently produce a scratched or marred product. The scratch or mar is not removed during the drawing process, but is lengthened in the drawn product. To avoid this problem, the sharp edge can be refinished, but this increases production cost.

Still another problem is that two nibs can be purchased for drawing the same size incoming material, but which can differ in shape or geometry in the entrance cavity, exit cavity, and the upper portion of the reduction cavity. The resulting recut nibs generally bear no geometric similarity in appearance to the original nib or other recut nibs, a result not desired in the industry.

A further problem associated with the prior art nib is the increased difficulty and cost in machining the curved inner surface of the entrance cavity.

Attempts have been made to rectify the above problems, one of which is to provide the entrance cavity with a straight-line or conical surface instead of a curved surface. Although this somewhat alleviates a few of the above problems, it does not eliminate them.

As prior art nibs continue to be recut, the geometry of the cavities and bearings become undesirably distorted. Further, there is no disclosure, to the best of applicant's knowledge, in the prior art of any formulas, equations, or the like, which can be used in a process or method of manufacturing a nib which, upon being recut, yields a recut nib substantially maintaining geometric similarity with the original nib.

In view of the above, there clearly exists a need for a nib, and a method of its production, which upon being recut substantially maintains a desired geometric relationship between the cavities so as to produce acceptable drawn products.

SUMMARY OF THE INVENTION

The present invention overcomes the problems and disadvantages of the prior art described above by providing a nib uniquely manufactured by a method which, upon recutting, yields a recut nib substantially geometrically similar to the original nib.

The present invention provides a formula for determining the entrance angle and another formula for determining the exit angle. These angles are calculated generally as a function of the shape of the reduction cavity and the bearing cavity. The method of the present invention utilizes these formulas to produce a nib which can be recut into subsequent nibs having substantial geometric similarity with the original nib.

The method of the present invention minimizes the increase in length of the reduction cavity upon recutting the nib, and provides for the impact plane of the recut nib to be located in the reduction cavity such that an incoming material is drawn by about 50% to 60% of the reduction cavity length. This is to be contrasted with most prior art recut nibs wherein the material is drawn by about 30% of the reduction cavity length. Moreover, the method also minimizes the decrease in the length of the entrance cavity after recutting.

The entrance cavity of the nib of the present invention has a conical or straight-line surface, and upon recutting the nib, the surface of the entrance cavity presents a smaller transition between the entrance cavity and reduction cavity. This minimizes the potential of scratching or marring the surface of a material drawn through the recut die, and reduces the need for refinishing the transition, thereby minimizing costs in recutting nibs.

Nibs manufactured in accordance with the method of the present invention can be recut to yield a more uniform series of recut nibs and consequently more uniform drawn products. For example, uniformity can be maintained in recut nibs within the "R-series" of nibs. For example, if the manufactured nib is an R-5 with a bearing cavity diameter of 0.080 inches, it may be subsequently recut to an R-5 having a bearing cavity diameter of 0.160 inches. This recut R-5 nib having a bearing cavity diameter of 0.160 inches is substantially geometrically identical or similar to a manufactured R-5 nib having an original bearing cavity diameter of 0.160 inches. This results in substantial savings to the user since recutting a nib to the next larger size is much less expensive than buying a new nib having the same next larger size. Further, all other nibs manufactured in accordance with the method of the present invention as an R-5 with any bearing cavity diameter will be substantially identical when purchased or recut to a bearing cavity diameter of 0.160 inches, thereby resulting in uniform drawn products. This geometric similarity exists between different nib sizes for similar applications.

Further advantages of the nib of the present invention exist in eliminating the curved surface of the entrance cavity and using instead a straight-line surface, which makes the nib easier to manufacture and requires less material with which to manufacture the nib.

Still another advantage associated with the nib of the present invention is the exit cavity, which is machined or formed in the nib, having an exit angle determined by the method of the present invention. The calculated exit angle "opens up" the exit cavity so that in recutting the nib to the next larger size, typically minimal recutting of the exit cavity is required. This further provides a reduction in manufacturing cost since excess starting material for the manufacture thereof is eliminated. The need for refinishing or polishing a newly recut exit cavity is minimized.

In one form of the invention there is provided a nib adapted for use in a drawing die for drawing incoming material comprising a nib body having top and bottom sides. The nib body includes an entrance cavity in the top side having a surface tapering inwardly and downwardly at a first angle from the top side into the nib body, and a reduction cavity having a surface tapering inwardly and downwardly at a second angle from the entrance cavity and having a transversely disposed impact plane therein. A bearing cavity having a surface extends generally vertically downwardly from the reduction cavity through the bottom side of the nib body. Each of the cavities communicates with adjacent ones of the other cavities. The entrance angle of the entrance cavity is predetermined as a function of a first ratio of the maximum transverse dimension of the reduction cavity at the impact plane to the maximum transverse dimension of the bearing cavity, a fraction of the reduction cavity used in the drawing process, and the reduction angle of the reduction cavity, whereby when the nib body is recut a second ratio of the maximum transverse dimension of the recut reduction cavity to the maximum transverse dimension of the recut bearing cavity is equal to a third ratio of the maximum transverse dimension of the original reduction cavity to the maximum transverse dimension of the original bearing cavity, thereby maintaining geometric similarity between the uncut nib and subsequent recut nibs.

In the method of the present invention there are the steps of providing a nib body, and selecting a reduction angle, a maximum transverse bearing cavity dimension, a fraction of the reduction cavity to be used in drawing, and a maximum transverse dimension of incoming material to be drawn. Then, the entrance angle is determined as a function of the reduction angle, maximum transverse bearing cavity dimension, fraction of the reduction cavity used in drawing, and maximum transverse incoming material dimension. Thereafter, there is formed in the nib body the entrance cavity having the determined entrance angle, the reduction cavity having the selected reduction angle, and the bearing cavity having the selected transverse bearing dimension.

It is an object of the present invention to provide a nib, and a method of its manufacture, which can be recut to subsequent larger sizes which maintain geometric similarity with the original nib.

Another object of the present invention is to provide a nib, and a method of its manufacture, which when recut minimizes the increase in length of the reduction cavity and bearing cavity.

Yet another object of the present invention is to provide a nib, and a method of its manufacture, which when recut substantially maintains the impact plane of an incoming material to be drawn at the desired fraction of the reduction cavity.

A further object of the present invention is to provide a nib, and a method of its manufacture, which is less expensive to manufacture and requires less material in the manufacture thereof.

Yet a further object of the present invention is to provide a nib, and a method of its manufacture, which has an exit cavity typically requiring minimal recutting in recutting the nib to a larger size.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF THE PREFERRED EMBODIMENTS

Figures 1, 2:
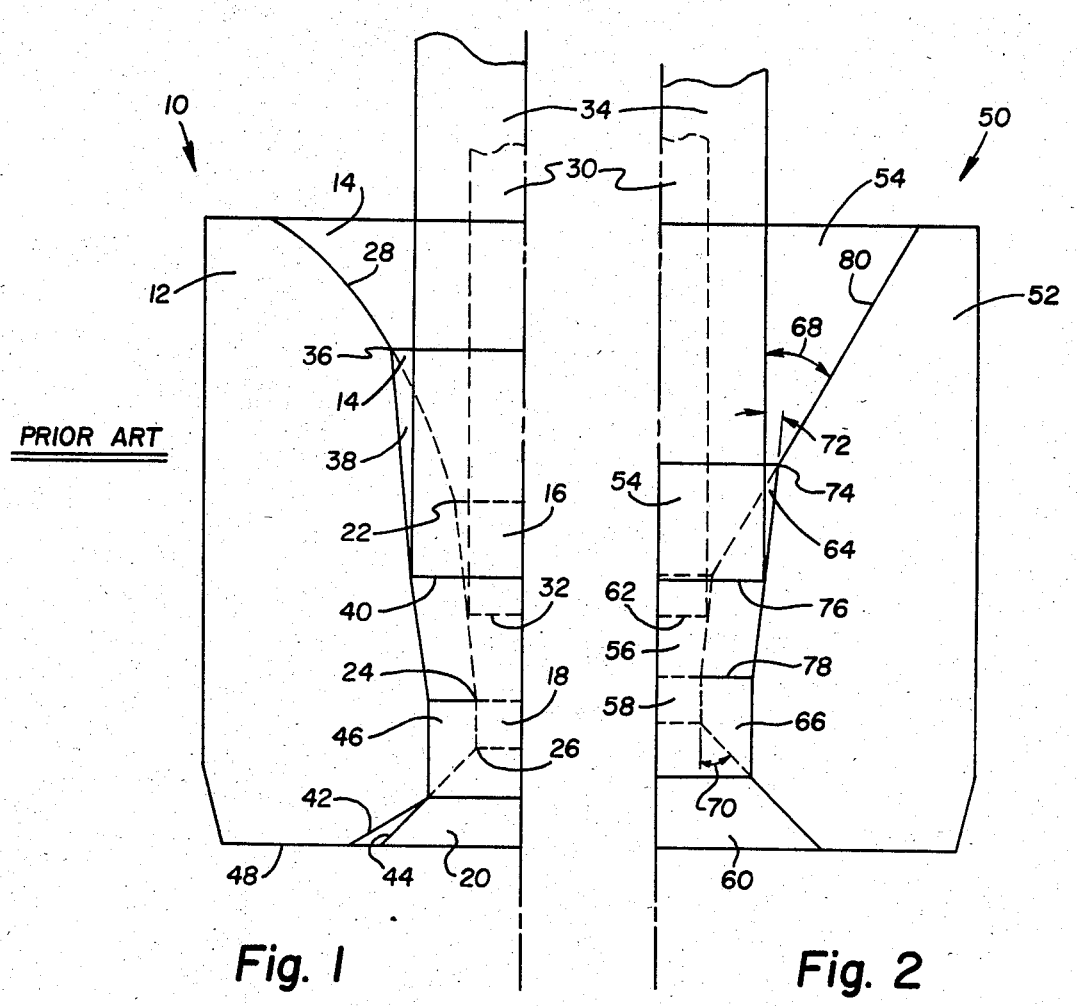
FIG. 1 is a sectional view of the left half of a prior art nib.
FIG. 2 is a sectional view of the right half of one embodiment of a nib manufactured in accordance with the method of the present invention.

Referring to FIG. 1, the left half of prior art nib 10 is shown in section and comprises nib body 12 having originally formed therein entrance cavity 14, reduction cavity 16 shown in dashed lines, bearing cavity 18 shown in dashed lines, and exit cavity 20 shown in dashed lines. Entrance cavity 14 and exit cavity 20 are shown in solid and dashed lines, the dashed line portion representing the original uncut prior art nib 10 and the solid line portion representing the recut prior art nib 10. In the uncut prior art nib 10, entrance cavity 14 and reduction cavity 16 intersect at transition 22; reduction cavity 16 and bearing cavity 18 intersect at transition 24; and bearing cavity 18 and exit cavity 20 intersect at transition 26. Entrance cavity 14 has a smoothly curved surface 28, the bottom portion of which may be frusto-conically shaped; reduction cavity 16 and exit cavity 20 are frusto-conically shaped; and bearing cavity 18 is cylindrically shaped. Further, it should be noted that the total surface of entrance cavity surface 28 may be frusto-conical rather than curved, but in most prior art nibs 10 surface 28 is as illustrated.

Continuing to refer to FIG. 1, the incoming material to be drawn shown in dashed lines 30 is illustrated in position in prior art nib 10 at the beginning of the drawing process. The position at which incoming material 30 contacts reduction cavity 16 is a transverse impact plane 32 having the same diameter as incoming material 30 and from this point on, incoming material 30 is drawn to the diameter or dimension of the bearing cavity 18 and the bottom of reduction cavity 16. It is desirable that impact plane 32 be located substantially midway in reduction cavity 16 so that incoming material 30 is drawn through about 50% to 60% of the length of reduction cavity 16, thereby ensuring proper lubrication and drawing of incoming material 30 through prior art nib 10.

In selecting the correct prior art nib 10 for drawing incoming material 30 to a desired diameter or dimension, the user selects prior art nib 10 having the desired bearing cavity 18 and reduction cavity 16 to produce the desired drawn product. One of the problems associated with prior art nibs, such as prior art nib 10, is that there is generally no commonly practiced standard for the profiles of entrance cavity 14, reduction cavity 16, and exit cavity 20 for a particular size of a bearing cavity 18. Generally, prior art nibs 10 differ widely in the angles of cavities 14, 16, 20 for any one bearing cavity 18. The problem becomes particularly acute when prior art nib 10 becomes worn and is recut to a larger size. Because prior art nibs 10 have different profiles as explained, when they are recut to a larger size, each one has a different interior profile for the same size incoming material to be drawn.

FIG. 1 illustrates in solid lines prior art nib 10 recut to a larger size and illustrates incoming material 34 to be drawn positioned therein at the beginning of the drawing process. One of the disadvantages in the recut prior art nib 10 is the formation of a sharp transition 36, which is the juncture between the original entrance cavity 14 and the new recut reduction cavity 38. If left as illustrated in FIG. 1, this sharp transition 36 can damage or scratch incoming material 34 during the drawing process, thereby resulting in a drawn product of poor quality. Any scratch made in incoming material 34 is not removed by the drawing process, but rather is stretched or elongated in length in the drawn product. Naturally, transition 36 can be eliminated, but this requires refinishing and polishing, thereby increasing costs in recutting.

Another disadvantage with recut prior art nib 10 is that the new impact plane 40 of incoming material 34 is located at a lower point in new recut reduction cavity 38. As prior art nib 10 is continually recut to a larger size during its useful life, impact plane 40 continues to move proportionately lower.

A further disadvantage with recut prior art nib 10 is that exit cavity 20 may require recutting as illustrated by line 42. It should be recognized that the recutting of exit cavity 20 may result in a surface having an angular inclination as illustrated by line 42 or can parallel the original surface 44 of uncut exit cavity 20. Regardless, the fact that exit cavity 20 requires recutting also necessitates further refinishing and polishing, which also increases cost in recutting.

A problem further associated with recutting exit cavity 20 as illustrated in FIG. 1 is that recut bearing 46 tends to move toward bottom side 48 of prior art nib 10 when the recutting is performed to maintain the top of the bearing constant, i.e., transition 24 desirably remains at a constant vertical or axial position in prior art nib 10 during subsequent recuttings as illustrated in FIG. 1. During any recutting process, reduction cavity 16 and bearing cavity 18 necessarily increase not only in width but also in length, and, if recut to maintain the top of the bearing constant, the increase in length of recut bearing 46 occurs downwardly toward bottom side 48 as shown.

Referring now to FIG. 2, nib 50 of the present invention is illustrated in side-by-side relation with prior art nib 10 of FIG. 1. Both prior art nib 10 and nib 50 shown are designed to draw an incoming material of the same diameter or dimension to a drawn material having the same diameter or dimension. Nib 50 includes nib body 52 having formed therein entrance cavity 54, reduction cavity 56, bearing cavity 58, and exit cavity 60. The original uncut nib 50 is illustrated such that the lower portion of entrance cavity 54 is in dashed lines, reduction cavity 56 and bearing cavity 58 are in dashed lines, and the upper portion of exit cavity 60 is in dashed lines. Incoming material 30 is illustrated in dashed lines at the beginning of the drawing process and impact plane 62 of incoming material 30 is spaced slightly above the midpoint of the axial length of reduction cavity 56. The maximum dimension or diameter of reduction cavity 56 at impact plane 62 is the same as the maximum dimension or diameter of incoming material 30.

FIG. 2 depicts in solid lines recut nib 50 having entrance cavity 54, recut reduction cavity 64, recut bearing cavity 66, and exit cavity 60. Nib 50 is illustrated in accordance with the method of the present invention in which entrance angle 68 and exit angle 70 have been predetermined generally as a function of the desired reduction cavity and percent bearing, respectively. It should be noted that as illustrated, angle 68 and 70 are one-half of the angles determined with the method of the present invention. Percent bearing is determined by the dimensions of the bearing cavity and is the ratio of the vertical or axial length of the bearing cavity to the diameter of the bearing cavity expressed as a percentage. Nib 50 is manufactured in accordance with the method of the present invention, and upon being recut eliminates the above mentioned problems associated with prior art nib 10. For example, transition 74 between entrance cavity 54 and recut reduction cavity 64 lies at a vertically or axially lower position in nib body 52 than does transition 36 in prior art nib body 12. Moreover, impact plane 76 of incoming material 34 is at the desired point or position in recut reduction cavity 64, so that incoming material 34 is drawn through about 50% to 60% of the lower portion of recut reduction cavity 64, thereby yielding a high quality drawn product.

Another advantage with recut nib 50 is that transition 74 between entrance cavity 54 and recut reduction cavity 64 forms a less severe transition or edge after recutting, thereby minimizing potential scratching or marring of incoming material 34 during the process.

Still another advantage with recut nib 50 is that exit cavity 60, which is determined by the method of the present invention, typically requires minimal or no recutting and refinishing as does recut surface or line 42 of exit cavity 20 of prior art nib 10. This is because bearing cavity 66 is cut until it intersects exit cavity 60. In recutting nib 50, top 78 of bearing cavity 58 is maintained at the same point or axial position in nib body 52.

Yet another advantage of nib 50 can be seen by comparing recut prior art nib 10 with recut nib 50 in FIGS. 1, 2, respectively. In recutting both nibs 10 and 50, it can be seen that more material used in the manufacturing thereof is required to be removed in recutting prior art nib 10 than in recutting nib 50, and this excess represents the excess material required in originally manufacturing prior art nib 10. Therefore, nib 50 is manufactured using less material and is less expensive to produce.

In the embodiment illustrated in FIG. 2, entrance cavity 54 has a surface 80 and is frusto-conically shaped, as are reduction cavities 56, 64 and exit cavity 60, and bearing cavities 58, 66 are cylindrically shaped. Although some prior art nibs 10 may have a straight-line surface instead of a curved surface 28, none of the prior art nibs 10, to the best of applicants' knowledge, are manufactured in accordance with any standards or formulas which yield an entrance angle and an exit angle determined generally as a function of a selected reduction cavity and bearing cavity.

Figure 3:
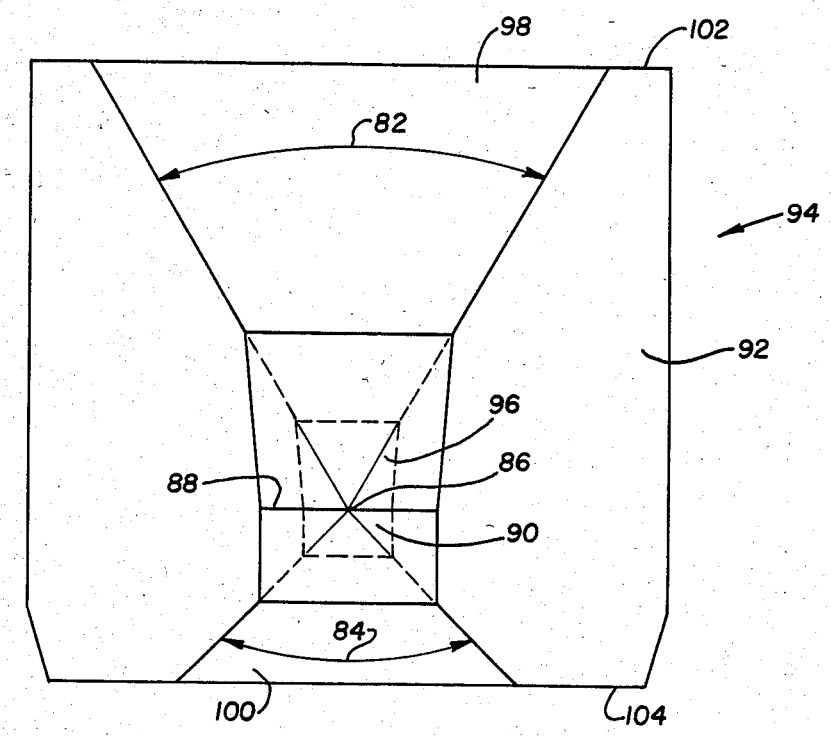
FIG. 3 is a sectional view of the embodiment of FIG. 2 illustrating in dashed lines the uncut embodiment and in solid lines the recut embodiment.

Referring now to FIG. 3, the method of the present invention in manufacturing nib 50 will be explained. Given in the following Table 1 are dimensions of typical working embodiments resulting from the method of this invention, and are intended to be exemplary only and not limitative of the invention:

TABLE 1

| PERCENT BEARING | REDUCTION ANGLE | ENTRANCE ANGLE | EXIT ANGLE | D1/DF | B |
|---|---|---|---|---|---|
| 20 | 12 | 66.72 | 136.4 | 1.19 | 1.5 |
| 20 | 12 | 53.85 | 136.4 | 1.26 | 2 |
| 20 | 12 | 45.34 | 136.4 | 1.34 | 2.5 |
| 20 | 12 | 39.37 | 136.4 | 1.42 | 3 |
| 20 | 12 | 34.98 | 136.4 | 1.5 | 3.5 |
| 20 | 12 | 31.63 | 136.4 | 1.59 | 4 |
| 40 | 16 | 82.72 | 102.68 | 1.19 | 1.5 |
| 40 | 16 | 68.36 | 102.68 | 1.26 | 2 |
| 40 | 16 | 58.37 | 102.68 | 1.34 | 2.5 |
| 40 | 16 | 51.13 | 102.68 | 1.42 | 3 |
| 40 | 16 | 45.7 | 102.68 | 1.5 | 3.5 |
| 40 | 16 | 41.49 | 102.68 | 1.59 | 4 |
| 60 | 20 | 95.69 | 79.61 | 1.19 | 1.5 |
| 60 | 20 | 80.86 | 79.61 | 1.26 | 2 |
| 60 | 20 | 70.04 | 79.61 | 1.34 | 2.5 |
| 60 | 20 | 61.94 | 79.61 | 1.42 | 3 |
| 60 | 20 | 55.72 | 79.61 | 1.5 | 3.5 |
| 60 | 20 | 50.83 | 79.61 | 1.59 | 4 |

D1/DF is the ratio of the maximum transverse dimension of the reduction cavity to the maximum transverse dimension of the bearing cavity, and it is this ratio which remains substantially constant during the recutting of nibs of the present invention. All angles are included angles, and are not to be confused with half-angles or the like, unless indicated to the contrary.

Referring still to FIG. 3, a sample calculation in accordance with the method of the present invention will be made with the top 88 of bearing cavity 90 constant. In the sample calculation below, the following data may be received from the customer:

(i) Percent Bearing=50

(ii) Reduction Angle=14°

(iii) Bearing Cavity Diameter=0.020101 inches (iv) Fraction of the reduction cavity length used to draw the material=½

(v) Initial diameter of the incoming material to be drawn=0.022572 inches

The following are the formulas for calculating the entrance angle and exit angle based on the above-given data:

$$\text{Entrance angle (82)} = 180° - \left[2 \times \text{atn}\left(\frac{K^B - 1}{\tan\left(\frac{A}{2}\right) \times K^B}\right)\right]$$

$$\text{Exit angle (84)} = 180° - \left[\left(\text{atn}\,\frac{C}{50}\right) \times 2\right]$$

Where K=the ratio of the maximum transverse of the incoming material to be drawn to the maximum transverse dimension of the bearing cavity, A=the reduction angle, B=the exponent of K and is the denominator of the fraction of the reduction cavity used to draw the incoming material with the numerator equal to 1, C=percent bearing, tan is the tangent, and atn is the arctangent.

Based on the above given data and formulas, the following is a sample calculation for the entrance angle 82 and exit angle 84:

$$\text{Entrance angle (82)} = 180° - \left[2 \times \text{atn}\left(\frac{K^B - 1}{\tan\left(\frac{A}{2}\right) \times K^B}\right)\right]$$

where

K=0.022572÷0.020101=1.12293,

A=14°,

B=2, and

C=50.

$$\text{Entrance angle (82)} = 180° - \left[2 \times \text{atn}\left(\frac{1.12293^2 - 1}{\tan\left(\frac{14}{2}\right) \times 1.12293^2}\right)\right]$$

$$\text{Entrance angle (82)} = 61.36°$$

$$\text{Exit angle (84)} = 180° - \left[\left(\text{atn}\,\frac{C}{50}\right) \times 2\right]$$

$$\text{Exit angle (84)} = 180° - \left[\left(\text{atn}\,\frac{50}{50}\right) \times 2\right]$$

$$\text{Exit angle (84)} = 90°$$

After determining entrance and exit angles, the entrance cavity, reduction cavity, bearing cavity and exit cavity are then properly formed as illustrated in FIG. 3, wherein the entrance angle 82 and the exit angle 84 intersect at a common point 86. Point 86 represents the location of the top 88 of bearing cavity 90. With the known percent bearing, which again is a ratio of the vertical or axial length of the bearing cavity to the diameter of the bearing cavity expressed in percent, and with the desired beginning bearing cavity diameter, bearing cavity 90 is then formed at its proper location in nib body 92 of nib 94. Thereafter, reduction cavity 96 is formed as illustrated in FIG. 3. The above cavities are optimally positioned in a selected nib body such that maximum nib utilization is realized.

Nib 94 manufactured in accordance with the method of the present invention can be recut so as to maintain geometric similarity, i.e., the calculated entrance angle 82 and the exit angle 84, upon recutting nib 94, cause the ratio of the maximum diameter of the recut reduction cavity to the diameter of the recut bearing cavity to equal the ratio of the maximum diameter of the original uncut reduction cavity to the diameter of the original uncut bearing cavity; these ratios being D1/DF in Table 1. By maintaining the ratios equal, which result in subsequent recut nibs having geometric similarity, the increase in axial length of the reduction cavity and bearing cavity is minimized as illustrated in FIG. 3 and earlier explained above.

In regard to the constant K in the above formulas, K can equal the diameter or transverse dimension of the incoming material to be drawn divided by the diameter or transverse dimension of the desired drawn product, or can equal the diameter or transverse dimension of the incoming material to be drawn divided by the diameter or transverse dimension of the bearing cavity, or can equal the diameter or transverse dimension of the reduction cavity at the impact plane divided by the diameter of the bearing cavity. As for the constant B in the above formulas, it is the denominator of the fraction of the reduction cavity used in the drawing process with the numerator equal to 1. For example, should the customer desire that two-fifths (2/5) of the reduction cavity be used in the drawing process, the constant B can be easily determined by dividing the numerator by itself and dividing the denominator by the numerator, thereby resulting in the fraction 1/2.5. B then equals 2.5.

Figure 4:
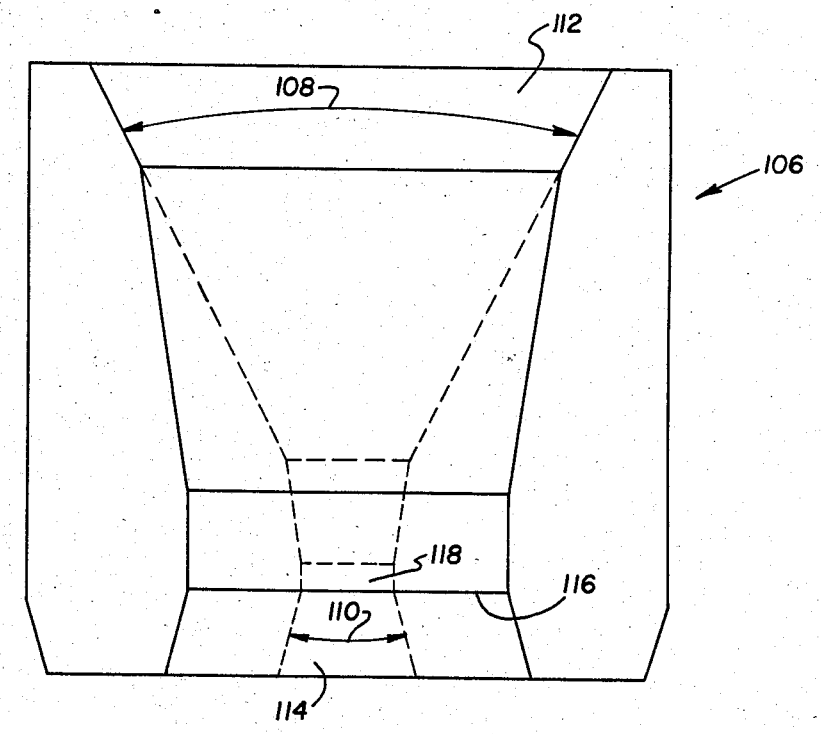
FIG. 4 is a sectional view of a second embodiment of a nib manufactured in accordance with the method of the present invention illustrating in dashed lines the original second embodiment and in solid lines the recut second embodiment.

Referring now to FIG. 4, there is illustrated a nib 106 manufactured in accordance with a modified method of the present invention, wherein the following formula is used to calculate entrance angle 108:

$$\text{Entrance angle (108)} = 180^\circ - \left[ 2 \times \text{atn} \left( \frac{\dfrac{K^B - 1}{2\tan\left(\dfrac{A}{2}\right)} + \dfrac{C}{100}}{0.5K^B} \right) \right]$$

The numbers represented by K, A, B, and C are determined as above, tan is the tangent, and atn is the arctangent.

The above formula is used to calculate entrance angle 108 of nib 106 which, upon being recut to keep the bottom of the bearing cavity constant, maintains geometric similarity to larger nibs recut therefrom.

Given below in Table 2 are dimensions of various working embodiments manufactured in accordance with the above formula with bottom 116 of bearing cavity 118 constant, and these are again exemplary only and not limitative of the invention:

TABLE 2

| PERCENT BEARING | REDUCTION ANGLE | ENTRANCE ANGLE | D1/DF | B |
|---|---|---|---|---|
| 20 | 12 | 56.66 | 1.19 | 1.5 |
| 20 | 12 | 47.25 | 1.26 | 2 |
| 20 | 12 | 40.74 | 1.34 | 2.5 |
| 20 | 12 | 36 | 1.42 | 3 |
| 20 | 12 | 32.42 | 1.5 | 3.5 |
| 20 | 12 | 29.62 | 1.59 | 4 |
| 40 | 14 | 53.77 | 1.19 | 1.5 |
| 40 | 14 | 46.64 | 1.26 | 2 |

TABLE 2-continued

| PERCENT BEARING | REDUCTION ANGLE | ENTRANCE ANGLE | D1/DF | B |
|---|---|---|---|---|
| 40 | 14 | 41.38 | 1.34 | 2.5 |
| 40 | 14 | 37.36 | 1.42 | 3 |
| 40 | 14 | 34.21 | 1.5 | 3.5 |
| 40 | 14 | 31.67 | 1.59 | 4 |
| 60 | 16 | 50 | 1.19 | 1.5 |
| 60 | 16 | 44.83 | 1.26 | 2 |
| 60 | 16 | 40.81 | 1.34 | 2.5 |
| 60 | 16 | 37.6 | 1.42 | 3 |
| 60 | 16 | 34.98 | 1.5 | 3.5 |
| 60 | 16 | 32.82 | 1.59 | 4 |

The calculation of the entrance angle of nibs wherein bottom 116 of bearing cavity 118 is constant during recutting is similar to the above calculation for a nib having the top of the bearing cavity constant when recut. Both of these embodiments of the nib of the present invention possess the earlier indicated advantages when recut to subsequent nibs. There is no formula for determining the exit angle for a nib to be recut with the bottom of the bearing cavity constant since the surface of the exit cavity, upon being recut, does not have another surface to intersect as does the reduction cavity surface which, upon being recut, intersects the entrance cavity surface. In recutting nib 106 manufactured by the modified method of the present invention, the exit cavity is recut directly through the bottom side of nib 106, the exit angle being a choice of the customer.

The nib of the present invention can be used for drawing wires, rods, tubes, and the like having any transverse cross-sectional shape. The incoming material to be drawn can be copper, aluminum, steel and the like.

While this invention has been described as having preferred embodiments, it will be understood that it is capable of further modifications. this application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. In a method for manufacturing a nib comprising an entrance cavity, a reduction cavity, an exit cavity, and a bearing cavity for use with a drawing die for drawing material, comprising the steps of providing a nib body, selecting a reduction angle, a maximum transverse bearing cavity dimension, a fraction of the reduction cavity to be used in drawing, and a maximum transverse material dimension, the improvement comprising the further steps of:

determining an entrance angle for the entrance cavity as a function of the reduction angle, maximum transverse bearing cavity dimension, fraction of the reduction cavity used in drawing, and maximum transverse material dimension, forming in the nib body the entrance cavity having the determined entrance angle, the reduction cavity having the selected reduction angle, and the bearing cavity having the selected bearing cavity dimension; and recutting the formed nib body to produce only a different bearing cavity and reduction cavity.

2. In a method for manufacturing a nib comprising an entrance cavity having a frusto-conically shaped entrance surface, a reduction cavity having a frusto-conically shaped reduction surface, an exit cavity having a frusto-conically shaped exit surface, and a bearing cavity having a cylindrical surface for use with a drawing die for drawing material, comprising the steps of:

providing a nib body, selecting a reduction angle wherein the reduction angle is the angle at which said reduction surface tapers, a maximum transverse bearing dimension, a fraction of the reduction cavity to be used in drawing, and a maximum transverse material dimension, the improvement comprising the further steps of:

determining an entrance angle for the entrance cavity as a function of the reduction angle, maximum transverse bearing cavity dimension, fraction of the reduction cavity used in drawing, and maximum transverse material dimension, said entrance angle being the angle at which said entrance surface tapers, the entrance angle is determined from the following relationship:

$$\text{entrance angle equals } 180° - \left[2 \times \text{ATN}\left(\frac{K^B - 1}{\tan\left(\frac{A}{2}\right) \times K^B}\right)\right]$$

where K is the ratio of the maximum transverse material dimension to the maximum bearing dimension, A is the reduction angle, B is the denominator of the fraction of the reduction cavity to be used in drawing with the numerator equal to one, tan is the tangent, and ATN is the arctangent, and forming in the nib body the entrance cavity having the determined entrance angle, the reduction cavity having the selected reduction angle, and the bearing cavity having the selected bearing cavity dimension.

3. The method of claim 2 further comprising the step of recutting the formed nib body while maintaining the axial position of the top of the bearing cavity in the nib body constant.

4. In a method for manufacturing a nib comprising an entrance cavity having a frusto-conically shaped entrance surface, a reduction cavity having a frusto-conically shaped reduction surface, an exit cavity having a frusto-conically shaped exit surface, and a bearing cavity having a cylindrical surface for use with a drawing die for drawing material, comprising the steps of:

providing a nib body, selecting a reduction angle wherein the reduction angle is the angle at which said reduction surface tapers, a maximum transverse bearing cavity dimension, a fraction of the reduction cavity to be used in drawing, and a maximum transverse material dimension, the improvement comprising the further steps of:

determining an entrance angle for the entrance cavity as a function of the reduction angle, maximum transverse bearing cavity dimension, fraction of the reduction cavity used in drawing, and maximum transverse material dimension, said entrance angle being the angle at which said entrance surface tapers, the entrance angle is determined from the following relationship:

$$\text{entrance angle equals } 180° - \left[2 \times \text{ATN}\left(\frac{K^B - 1}{\tan\left(\frac{A}{2}\right) \times K^B}\right)\right]$$

where K is the ratio of the maximum transverse material dimension to the maximum bearing dimension, A is the reduction angle, B is the denominator of the fraction of the reduction cavity to be used in drawing with the numerator equal to one, tan is the tangent, and ATN is the arctangent, and forming in the nib body the entrance cavity having the determined entrance angle and a frusto-conically shaped surface, the reduction cavity having the selected reduction angle, and the bearing cavity having the selected bearing cavity dimension.

5. The method of claim 4 wherein the step of selecting further includes selecting a percent bearing, the step of determining further includes determining an exit angle for the exit cavity from the following relationship:

$$\text{exit angle} = 180° - \left[\left(\text{atn}\,\frac{C}{50}\right) \times 2\right]$$

where C is the percent bearing and atn is the arctangent, and the step of forming further includes forming in the nib body the exit cavity having the determined exit angle.

6. In a method for manufacturing a nib comprising an entrance cavity having a frusto-conically shaped entrance surface, a reduction cavity having a frusto-conically shaped reduction surface, an exit cavity having a frusto-conically shaped exit surface, and a bearing cavity having a cylindrical surface for use with a drawing die for drawing material, comprising the steps of:

providing a nib body, selecting a reduction angle wherein the reduction angle is the angle at which said reduction surface tapers, a maximum transverse bearing cavity dimension, a fraction of the reduction cavity to be used in drawing, a percent bearing, and a maximum transverse material dimension, the improvement comprising the further steps of:

determining an entrance angle for the entrance cavity as a function of the reduction angle, maximum transverse bearing cavity dimension, fraction of the reduction cavity used in drawing, percent bearing, and maximum transverse material dimension, said entrance angle being the angle at which said entrance surface tapers, the step of determining the entrance angle is determined from the following relationship:

$$\text{entrance angle} = 180° - \left[2 \times \text{atn}\left(\frac{\frac{K^B - 1}{2\tan\left(\frac{A}{2}\right)} + \frac{C}{100}}{0.5K^B}\right)\right]$$

where K is the ratio of the maximum transverse material dimension to the maximum bearing dimension, A is the reduction angle, B is the denominator of the fraction of the reduction cavity to be used in drawing with the numerator equal to one, C is the percent bearing, tan is the tangent, and atn is the arctangent, and forming in the nib body the entrance cavity having the determined entrance angle, the reduction cavity having the selected reduction angle, and the bearing cavity having the selected bearing cavity dimension.

7. The method of claim 6 further comprising the step of recutting the formed nib body while maintaining the axial position of the bottom of the bearing cavity in the nib body constant.

8. The method of claim 7 wherein the step of forming further includes forming the exit cavity in the nib body.

* * * * *

UNITED STATES PATENT AND TRADEMARK OFFICE

CERTIFICATE OF CORRECTION

PATENT NO. : 4,567,793

DATED : February 4, 1986

INVENTOR(S) : Millner et al

It is certified that error appears in the above-identified patent and that said Letters Patent is hereby corrected as shown below:

Claim 2, Col. 11, Line 9, after "bearing" insert --cavity--.

Signed and Sealed this

*Seventeenth* Day of *June 1986*

[SEAL]

*Attest:*

DONALD J. QUIGG

*Attesting Officer*

*Commissioner of Patents and Trademarks*